US008770075B2

(12) United States Patent
Walther et al.

(10) Patent No.: US 8,770,075 B2
(45) Date of Patent: Jul. 8, 2014

(54) DEVICE FOR REMOVING PRECISION PUNCHING RESPECTIVELY FINE BLANKING PARTS FROM A TOOL OF A PRESS

(75) Inventors: Andreas Walther, Laupen (CH); Herbert Fuchs, Diessbach (CH); Simon Benjamin Walther, Melkirch (CH); Jürg Ochsenbein, Niederwangen bei Bern (CH)

(73) Assignee: Feintool Industrial Property AG, Lyss (CH)

( * ) Notice: Subject to any disclaimer, the term of this patent is extended or adjusted under 35 U.S.C. 154(b) by 482 days.

(21) Appl. No.: 12/960,054

(22) Filed: Dec. 3, 2010

(65) Prior Publication Data

US 2012/0097001 A1 Apr. 26, 2012

(30) Foreign Application Priority Data

Oct. 20, 2010 (EP) ..... 10013789

(51) Int. Cl.
*B21D 45/00* (2006.01)

(52) U.S. Cl.
USPC ..... 83/109; 83/129

(58) Field of Classification Search
USPC ..... 83/109, 111, 112, 129, 130, 135, 149, 83/165
See application file for complete search history.

(56) References Cited

U.S. PATENT DOCUMENTS

| | | | | | |
|---|---|---|---|---|---|
| 2,693,159 | A | * | 11/1954 | Taylor | 72/426 |
| 3,349,602 | A | * | 10/1967 | Nelson | 72/426 |
| 3,452,577 | A | | 7/1969 | Schmeltzer | |
| 3,705,525 | A | * | 12/1972 | Gilmour et al. | 83/112 |
| 4,068,519 | A | * | 1/1978 | Baringer | 72/426 |
| 4,096,728 | A | | 6/1978 | Glecker | |
| 4,370,878 | A | | 2/1983 | Carrieri | |
| 6,766,719 | B2 | * | 7/2004 | Van Liempd et al. | 83/27 |

FOREIGN PATENT DOCUMENTS

| | | |
|---|---|---|
| DE | 1 752 242 | 8/1971 |
| DE | 82 02 852 | 5/1982 |
| DE | 34 08 413 | 9/1985 |
| DE | 87 14 829 | 6/1988 |
| DE | 28 32 093 | 7/1988 |
| EP | 0 148 354 | 7/1985 |

* cited by examiner

*Primary Examiner* — Stephen Choi
(74) *Attorney, Agent, or Firm* — Jordan and Hamburg LLP

(57) ABSTRACT

Parts with high surface finish are removed from tools of a fine blanking press with accuracy and at high speed. The press has high opening and shutting speeds achieved by a direct drive having high acceleration power, a high turning moment, and small construction dimensions. A cross slide is movable transverse to a working direction of tool parts and is fixed at a frame of the direct drive. The direct drive includes a drive shaft which changes turning direction based on the stroke of a ram that is pivotally connected to the cross slide via an arm, a bracket, and a rapid-action coupling. Rotating motion is converted into a linear motion, which reverses between a rear stop position and a front stop position of the cross slide in a working area.

19 Claims, 8 Drawing Sheets

Figure 1:
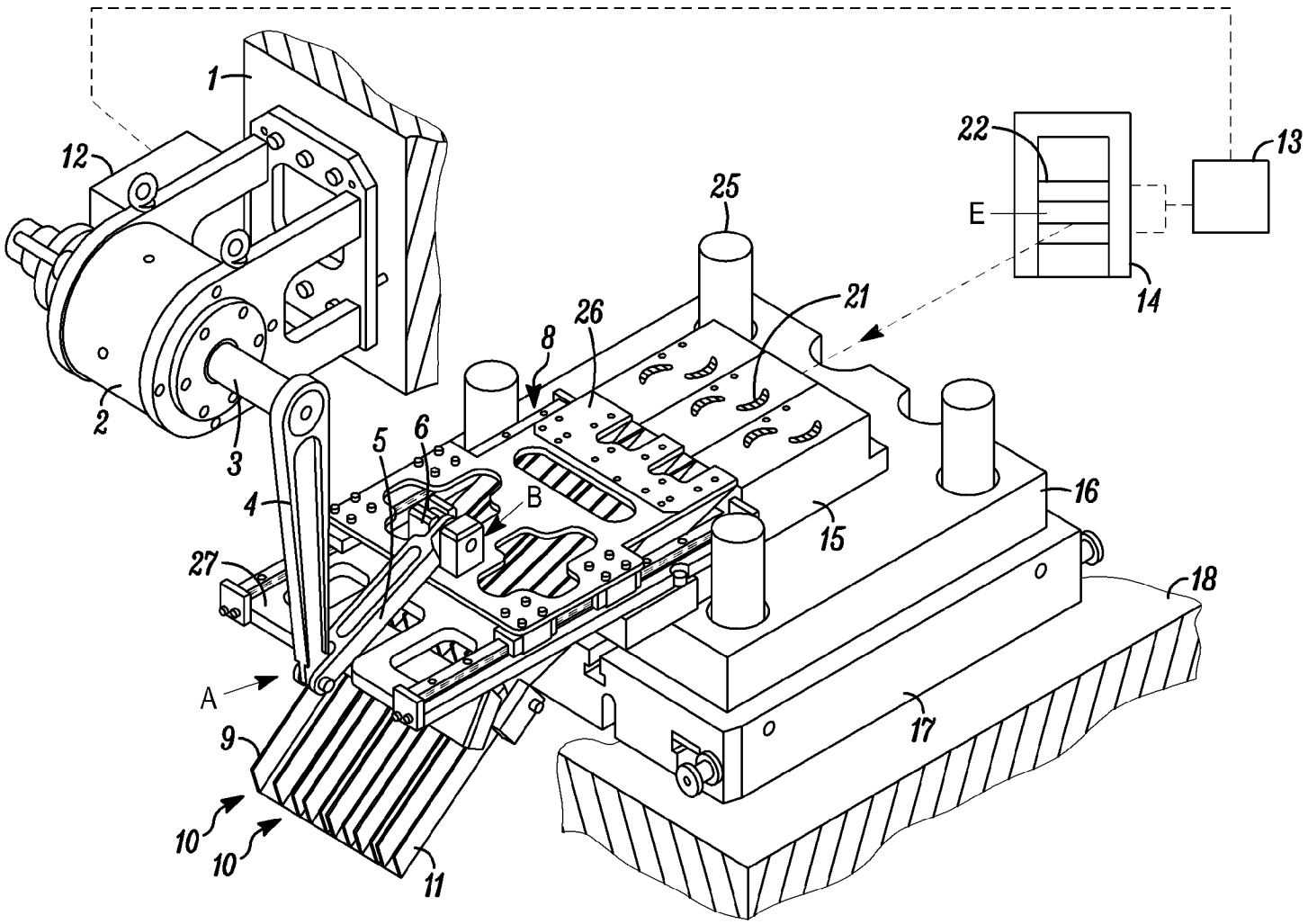

DEVICE FOR REMOVING PRECISION PUNCHING RESPECTIVELY FINE BLANKING PARTS FROM A TOOL OF A PRESS

This application claims priority under 35 U.S.C. §119(a) from pending EPO Application No. 10013789.2, filed on Oct. 20, 2010, the entirety of which is hereby incorporated by reference herein.

The invention relates to a device for removing precision punching respectively fine blanking parts from a tool of a mechanically or hydraulically driven press with a linked to the ram of the press tool part and a tool part on the bedplate of the press fixed at the frame of the press, a cross slide movable transverse to the working direction of the tool parts, which is developed movable into the working area between the tool parts when one of the tool parts opens and out of it to remove the parts out of the working area when one of the tool parts closes, wherein the cross slide is connected to a fixed at the frame of the press direct drive.

STATE OF THE ART

The productivity of high-speed presses also in the case of fine blanking presses essentially depends on the speed with which the finished work pieces are removed from the press.

It is known a great number of solutions for removing work pieces from punching machines, presses or the like using mechanic (DE 28 32 093 A1, DE 34 08 413 C2, DE 87 14 829 U1), hydraulic (DE 82 02 852 U1) or pneumatic (DE 1 752 242 A1, EP 0 148 354 B4) principles of operation.

From the DE 28 32 093 A1 is known a press with a slide movable in a stroke in the press frame, arranged at the slide and the bedplate of the press press tools, an adjusting device for adjusting the shut height of the slide with regard to the bedplate of the press and with an arranged at the bedplate of the press or the slide work piece ejector device that may be operated by means of operating elements arranged at the slide or the bedplate of the press in dependence of its stroke and adjusted by means of an adjusting device.

Furthermore, the DE 34 08 413 C2 describes a device for removing a work piece sticking to a punching tool after lifting up the tool holder subsequent to the punching process by means of an attached to an arm actuating tip the movement of which in cooperation with the moving tool holder is controlled by arms of a four-bar mechanism in such a way, that when the tool holder moves upwards the actuating tip moves below the tool holder and when the tool holder moves downwards again moves out of the area below the tool holder.

Another known solution (see DE 87 14 829 U1) provides a device for removing parts from a punching machine, press or the like having an ejector in the movable tool or articulated in the upper tool for removing the work piece from said tool during the return stroke of the upper, respectively movable tool, having a movable transverse to the working direction actuating device coupled to the motion of the movable tool, optionally moving an ejector element, which can be brought in contact to the work piece, into the working direction and out of it.

In the DE 82 02 852 U1 beyond that is disclosed a work piece ejector device for a press having a frame with a first tool and a in the frame relative to the first tool slide movable in a stroke between a first and a second slide position. The ejector device has an ejector, which is hydraulically actuated.

The DE 1 752 242 A1 instead of hydraulic actuating proposes a pneumatic actuation.

Further, from the EP 0 148 354 A1 is known a device for removing parts from a punching machine, a press or the like, in which the work piece is advantageously removed downwards by means of an ejector during the upwards leading return stroke. It is provided an extending transverse to the working direction diverting device supporting the work piece that leaves the tool from below, which optionally can be moved into the working direction of the upper tool. The used with this known solution blowing unit when hitting the parts causes a disperse spray of the oil on the parts causing the necessity of respective filter devices for cleaning the outgoing air to avoid a noxious pollution of the air in the room and the soiling of machines and work pieces, what additionally leads to rising expenditures.

All these known solutions have the common disadvantage, that they lead to a damage of the surface of the parts, on the one hand caused by the sudden impact of the working with high speed ejector elements on the surface of the parts, on the other hand because of the possible damage of the surfaces because the parts hit each other when leaving the working area between upper and lower tools.

Precision parts like all fine blanking parts not only have to meet high requirements with regard to tolerances, but also must have a high surface finish, that is why the known solutions lead to a high proportion of finishing the finished parts.

Moreover, with these known solutions it is not possible to separately remove work pieces and slugs from the tool, what leads to further rising expenditures and impairs the efficiency.

A further disadvantage is that the construction heights of the known solutions are much too big or even unsuitable for the available opening height of the tool, which, as everybody knows, at fine blanking is lower.

Furthermore, the known solutions also do not reach the necessary removing performance for high-speed presses.

Task

At this state of the art the invention has the task to provide a device for removing parts from the tool of a press, with which it is possible to remove parts from the tool with high surface finish and accuracy at high accelerations and speeds simultaneously saving costs.

This task is solved by a device of the above mentioned kind with the characterizing elements of claim 1.

Advantageous aspects of the device can be taken from the sub-claims.

The solution according to this invention proceeds from the realization that high ejection performances are connected to high shutting and opening speeds of the press and thus the removal of parts and slugs underlies a respective high dynamism, which can be guaranteed by means of a direct drive due to its high acceleration power, high turning moment and small construction dimensions.

This is reached by the direct drive comprising a drive shaft changing the turning direction in dependence of the stroke of the ram, which is pivoting connected to the cross slide via an arm, a bracket and a rapid-action coupling for converting the rotating motion into a linear motion, wherein the direction of the linear motion reverses between a front stop position and a rear stop position of the cross slide in the working area, and that the cross slide comprises a base plate and a parts plate to take hold of and remove the parts, wherein the parts plate between the rear and front stop positions is guided horizontally movable on rails positioned on the base plate.

According to the application the upper or lower tool part optionally can be arranged at the ram or at the frame of the press, so that the device according to the invention can be used for both fine blanking and punching.

It only has to be guaranteed that the respective active elements as cutting die, ejector, shearing punch, guiding plate and ejector are allocated to the respective tool parts according to their function.

In one preferred aspect the parts plate at its bottom side facing the ejector has a matched to the contour of the fine blanking parts mask or openings/recesses for taking hold of, gathering and removing the fine blanking parts from the working area, wherein the fine blanking parts with the ejector are pressed into the openings of the parts plate before it is moved from the front to the rear stop position and after the rear stop position has been reached are pushed onto a transport means below the parts plate to be removed.

It is of special advantage if the cross slide in addition to the parts plate has a fixedly arranged on the parts plate slug plate, on which a horizontally movable on rails slug slide is arranged relative to the moving position of the parts plate between an allocated to the rear stop position clearance hole in the slug plate, a clearance hole in the parts plate and a recess in the base plate. This enables separately removing the occurring during fine blanking or the like slugs and at the same time position oriented removing the fine blanking parts, what contributes to further raise the removing productivity.

Advantageously the openings in the parts plate on its side facing the ejector are covered by the slug plate, what simplifies the production of the mask in the parts plate for picking up and taking hold of the fine blanking parts.

In a further advantageous aspect of the invention the slug slide comprises a brush ring and a retaining plate, which are for moving between the front and rear stop positions on the slug plate are connected to a rope drive arranged alongside the rail. The brush ring together with the slug plate forms a receiving area for slugs, in which are collected the removed by the ejector slugs. By the rope drive the receiving area is moved relative to the parts plate, so that the slugs reach the clearance holes in the slug plate, the parts plate and the base plate and due to their gravity can be taken over by the arranged below the parts plate transportation means.

The enclosed by the brush ring receiving area secures, that despite of the high accelerations and speeds no slugs can spread in the working area and disturb the production sequence.

A further advantageous aspect of the invention provides, that the rope drive is made up of arranged at one longitudinal side of the parts plate pulleys, a running around the pulleys endless rope and a fixed at the retaining plate of the slug slide allocated to the front stop position catch, which clamps a rear portion of the rope facing the longitudinal side of the parts plate in the front stop position for moving the slug slide relative between the stop positions.

The relative movement of the slug slide is carried out because the rope drive is in contact with the parts plate by an allocated to the rear stop position, fixed to the base plate rope holding block, which holds the facing the longitudinal side of the parts plate front portion of the rope and thus causing an interaction between parts plate and rope drive, so that also the slug slide moves with the movement of the parts plate.

In a further advantageous aspect of the invention the parts plate can be designed as one-piece plate. It only has to be guaranteed that the recesses for receiving the fine blanking parts at the bottom side of the common plate do not have through openings in the plate.

A further advantageous development of the invention provides that the parts plate has a locking-/unlocking mechanism, which permits an unlocking of the parts plate as soon as the fine blanking parts by the holes in the parts plate are not received according to their true position. This guarantees a secure sequence and avoids damages of the invention according to the invention.

Of special advantage is, that the direct drive is a dynamic liquid-cooled torque motor, which guarantees quickly removing the parts and slugs during up to 100 strokes per minute and can be triggered by the drive of the press, so that the cross slide is able to move to its rear and front stop positions for taking hold and removing the work pieces with high repeating accuracy.

According to a further advantageous aspect of the invention are provided separated from each other chutes for separately removing fine blanking parts and slugs, wherein the chute for the slugs with regard to the chute for the fine blanking parts is subordinated.

In a further preferred aspect of the device according to the invention the pivoting linked to the arm bracket is connected to the parts plate of the cross slide by a rapid-action coupling and a capacity limiter, what enables a fast exchange of the specific cross slide for tools and fine blanking parts and significantly reduces the change-over times. The capacity limiter guarantees an interruption of the non-positive connection between bracket and parts plate as soon as failures lead to values exceeding the allowed forces and moments.

In a further aspect of the invention the base plate of the cross slide has a matched to the motion of the bracket recess, so that the motion of the bracket is not obstructed as soon as the bracket penetrates the base plate.

The solution according to the invention distinguishes in that it becomes possible to separately remove slugs and fine blanking parts from the tool at high speeds and despite of this to maintain the tolerances and the surface finish of the precision punching and fine blanking parts simultaneously saving costs.

Further advantages and details accrue from the following description with reference to the attached drawings.

EMBODIMENT

The invention in the following shall be explained at the example of two embodiments.

It is shown in

Figure 2:
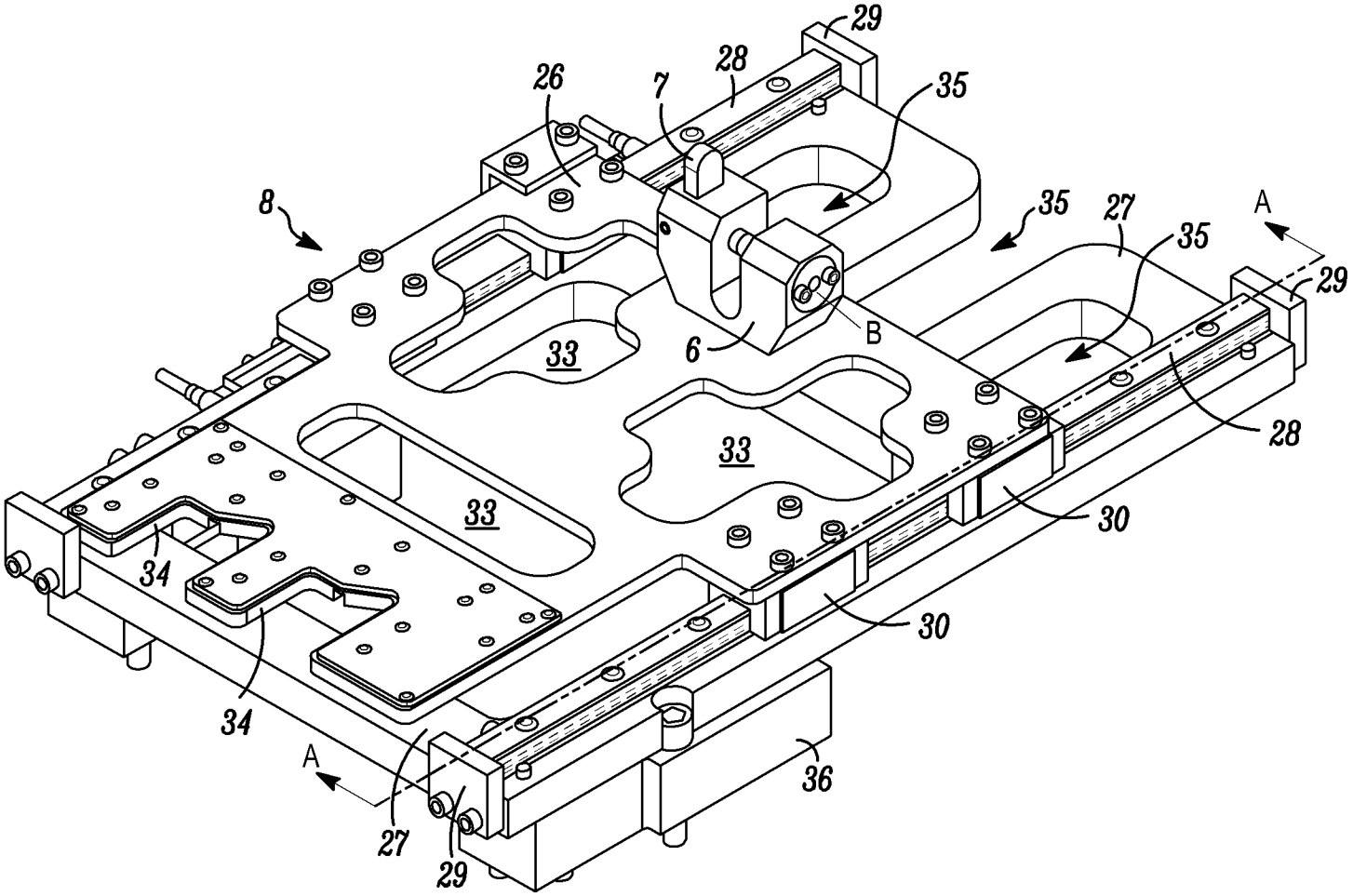
Figure 3:
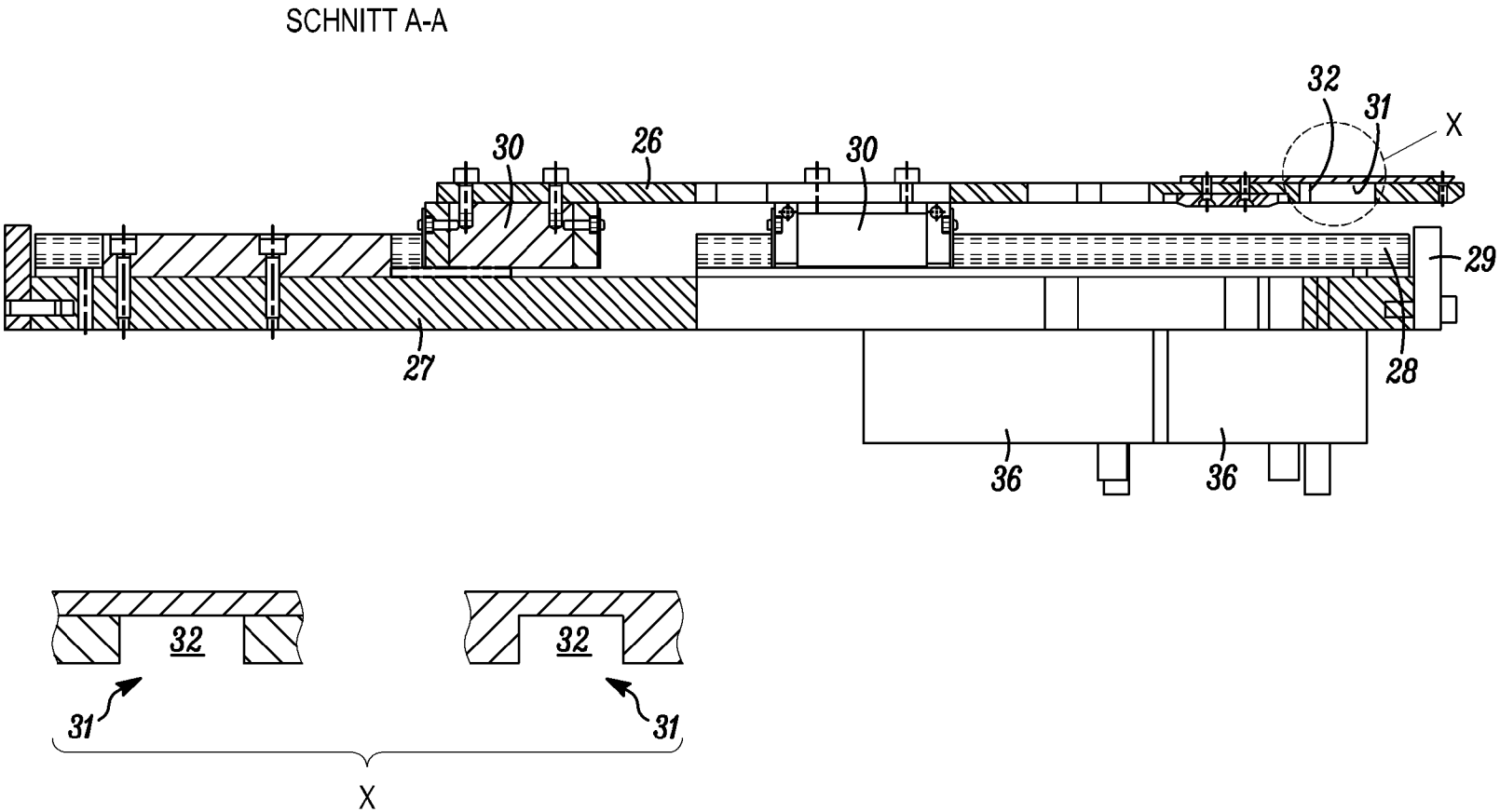
Figure 4:
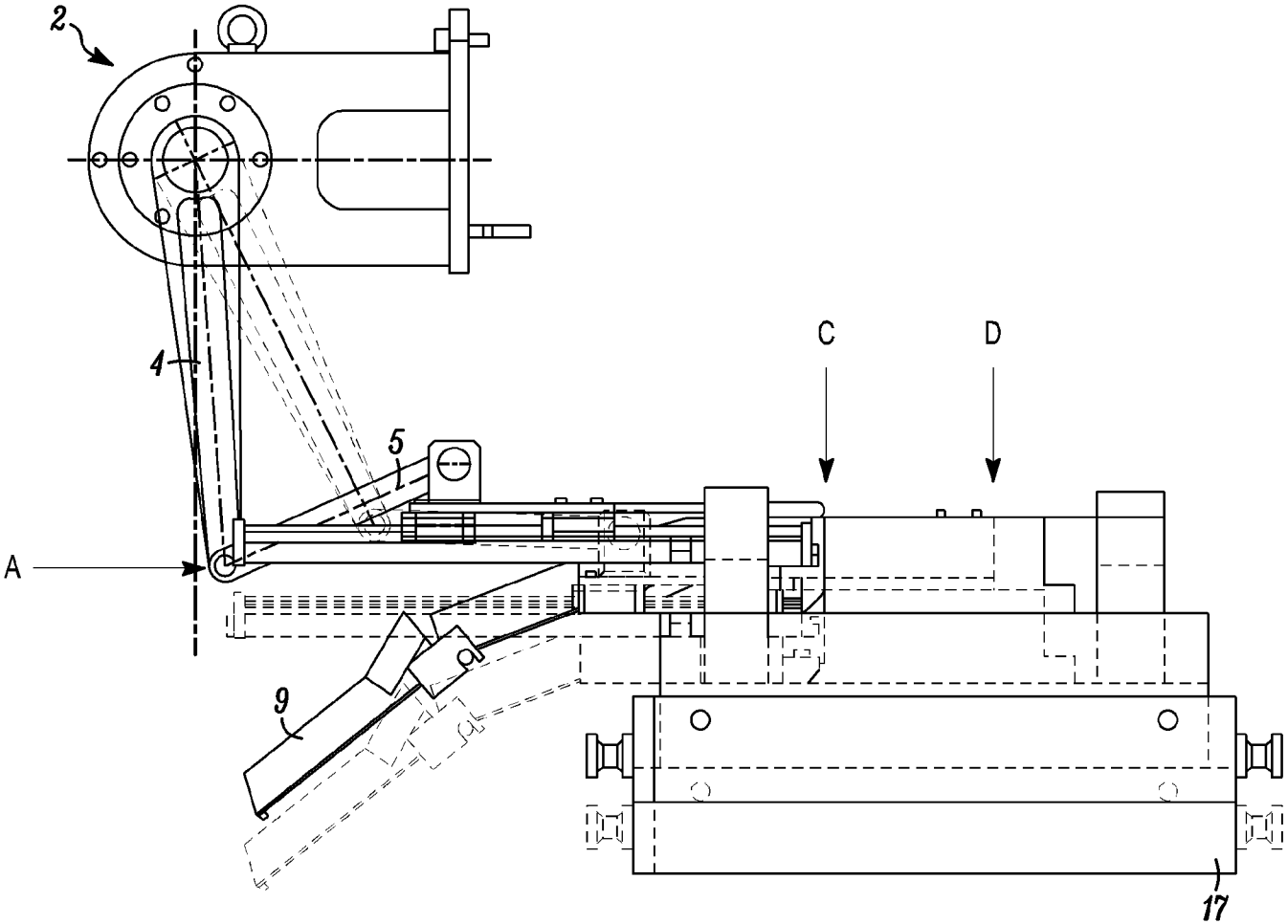
Figure 5:
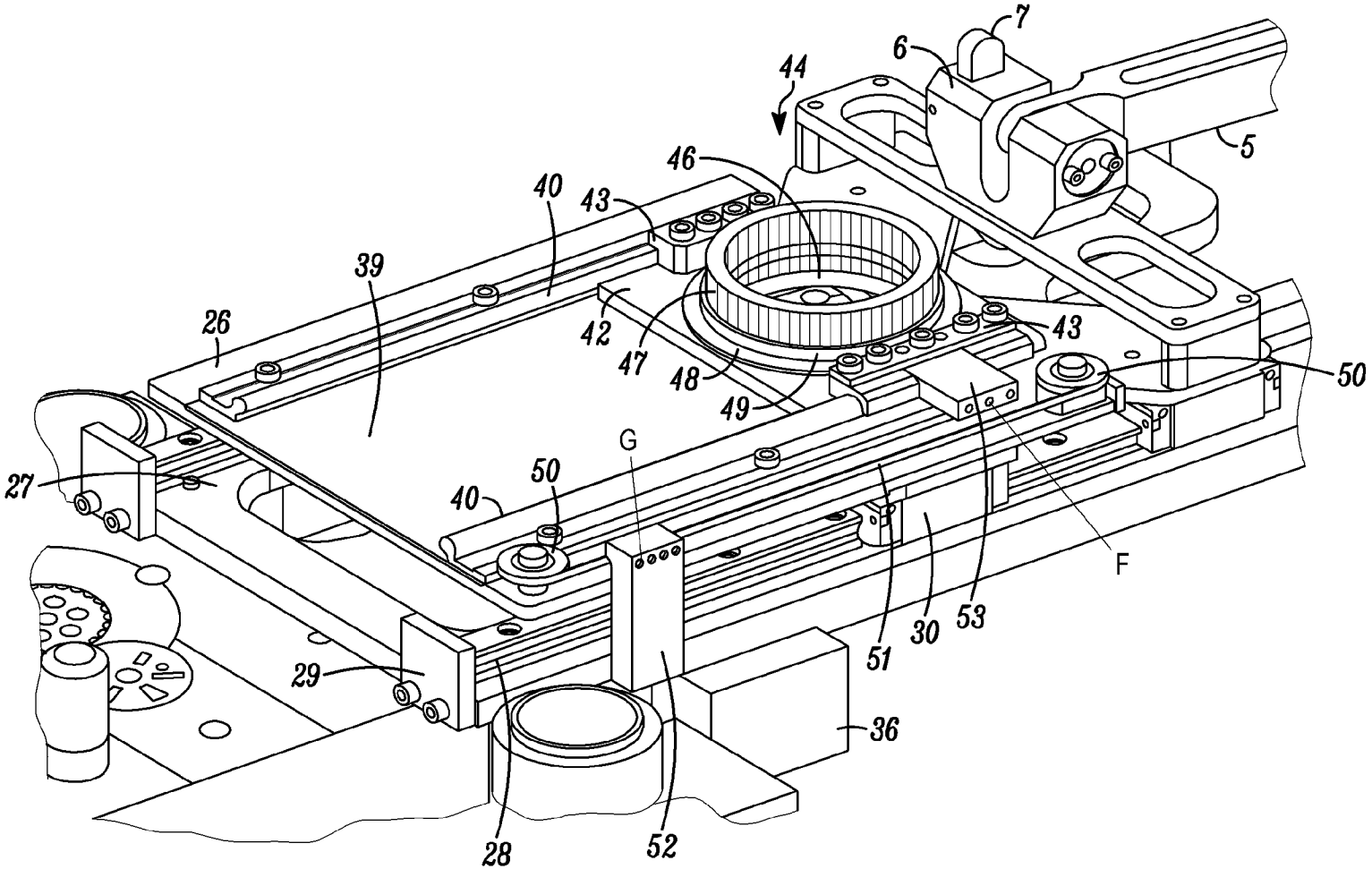
Figure 6:
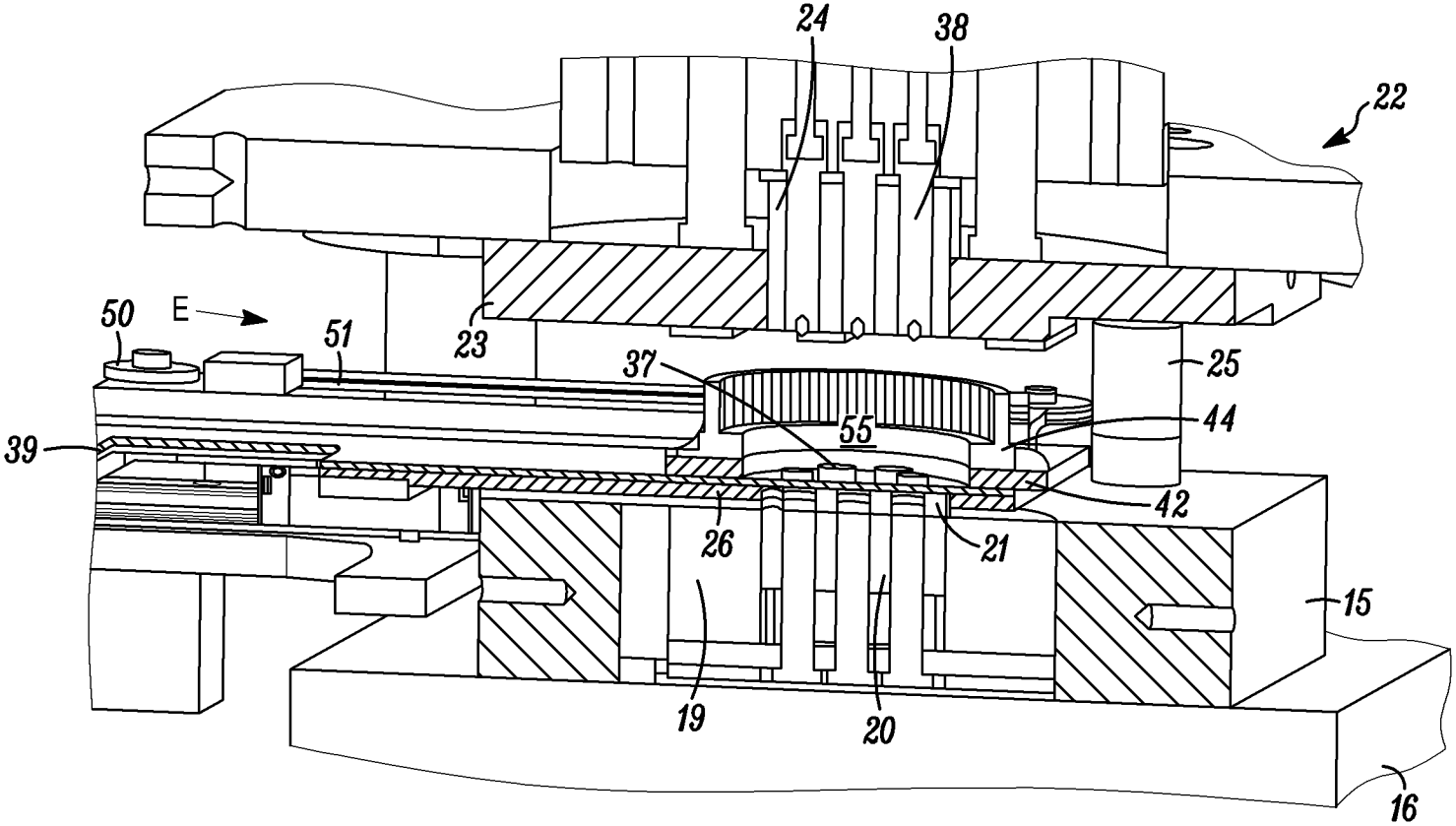
Figure 7:
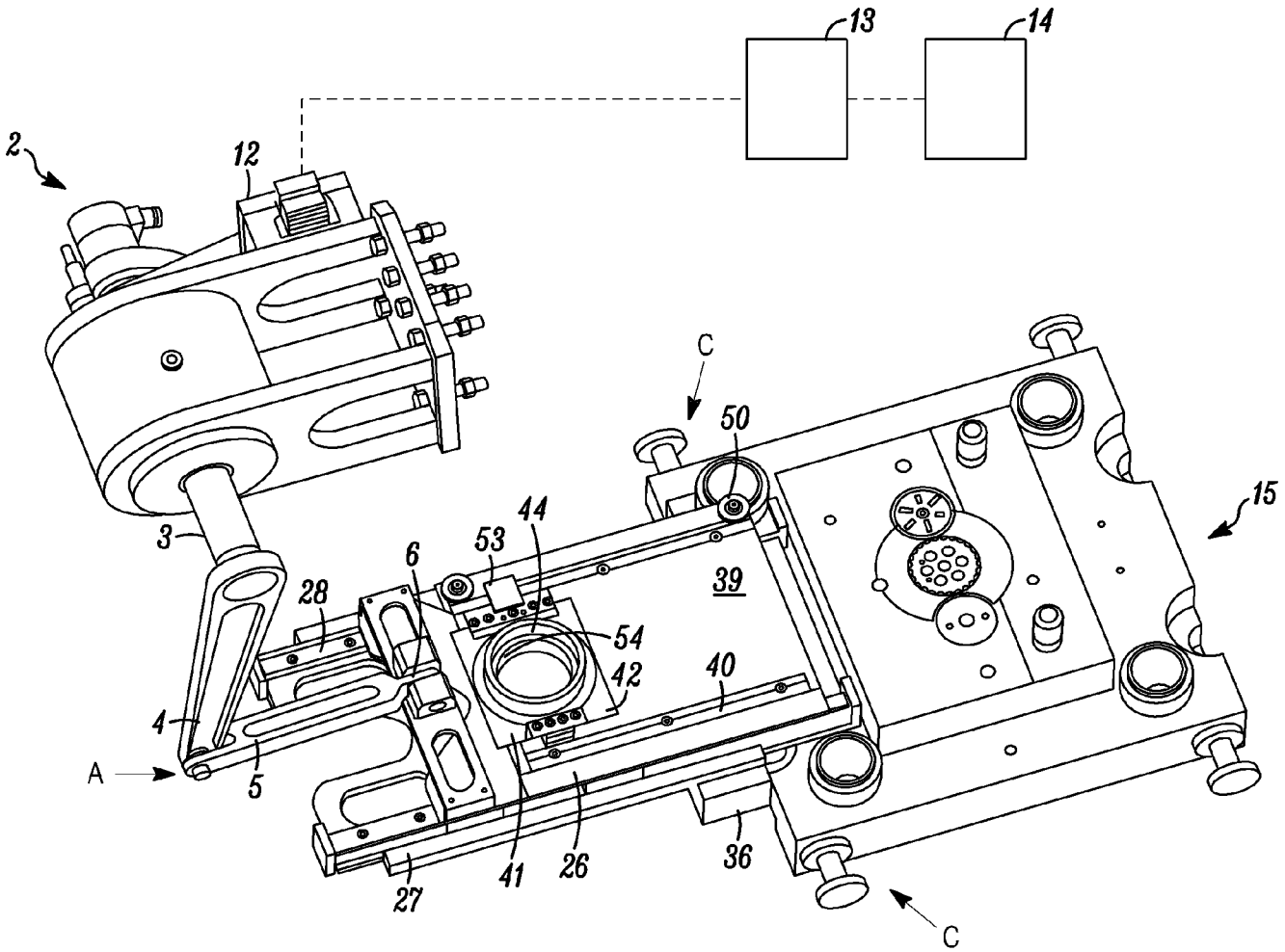
Figure 8:
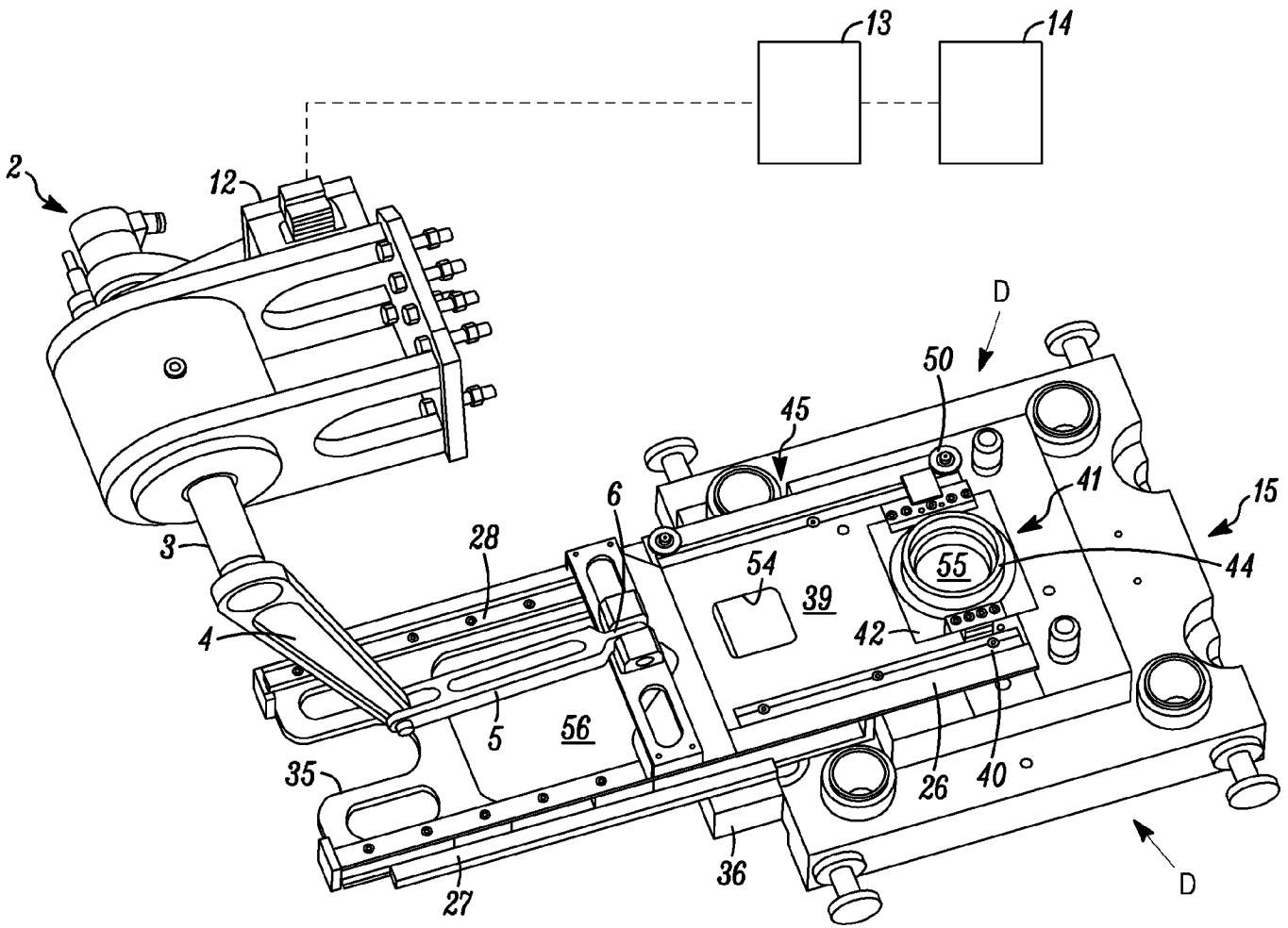

FIG. 1 a perspective view of direct drive, cross slide, lower tool part and chute, FIG. 2 a perspective top view of the cross slide, FIG. 3 a cross-section through the cross slide along line A-A of FIG. 2 with detail X, FIG. 4 a side view of the device according to the invention showing the front and rear stop positions of the cross slide in the lower tool part, FIG. 5 a perspective top view of the cross slide for separately removing slugs and fine blanking parts in the front stop position, FIG. 6 a schematic cross-section of the upper and lower tool parts with pushed in cross slide in the front stop position, FIG. 7 a perspective view of the device according to the invention for separately removing fine blanking parts and slugs in the rear stop position and FIG. 8 a perspective view of the device according to the invention for separately removing slugs and fine blanking parts in the front stop position.

EMBODIMENT 1

In the following described embodiment by means of the device according to the invention a fine blanking part without slugs shall be processed.

FIG. 1 schematically shows the basic structure of the device according to the invention, which is valid also for embodiment 2. A fixed at the frame 1 of the press 14 liquid-cooled torque motor as direct drive 2 via a shaft 3 drives an arm 4.

The direct drive 2 reaches accelerations of up to 100 $m/s^2$ and speeds of up to 3.5 m/s in a stroke of max. 250 mm.

The arm 4 at the one end is torsion-proof fixed to the shaft 3 and at the other end in the in the articulation point A articulated to a bracket 5, which on its part via a rapid-action coupling 6 and capacity limiter 7 (see FIG. 2) is articulated to a cross slide 8 in the articulation point B. Below the cross slide 8 is provided a transportation means 9 for example a chute for removing the parts. The chute consists of extending side by side having side walls 11 outlets 10, the width of which is matched to the dimensions of the parts.

The controlling means 12 of the torque motor is triggered by the controlling means 13 of the press 14, and that in that way that depending on the position of the ram the direction of the rotation of the shaft 3 is reversed, so that the arm 4 carries out a swiveling movement in changing directions, that is the articulation point A moves on an arc of an circle the respective reversal position of which is matched to the position of the ram. The articulated to articulation point B cross slide 8 during this carries out a linear motion between its front stop position D and its rear stop position C (see FIG. 4) with regard to the developed between lower and upper tool parts 15 respectively 22 working area E, when the tool is open.

The lower tool part 15 is arranged on a tool plate 16, which on its part is fixed on a tool change plate 17. The tool change plate 17 is hydraulically fixed on the bedplate of press 14. The lower tool part 15 comprises at least one cutting die 19 and one ejector 20, wherein the fine blanking part 21 is cut into the cutting die 19 by a shearing punch 24 guided in a guiding plate 23 in the upper tool part 22 when the tool is closed (see FIG. 6). The ejector 20 serves for pushing the fine blanking part 21 out of the cutting die 19. The upper tool part 22 is guided at pillars 25 of the screwed onto the tool change plate 17 tool plate 16.

The cross slide 8—as can be seen from FIGS. 2 and 3—consists of a parts plate 26 and a base plate 27. The base plate 27 at its longitudinal sides has rails 28, to which at the front sides of base plate 27 are allocated limit stops 29. The parts plate 26 at each of its longitudinal sides on the side facing the rails 28 at least has two running elements 30 guiding the parts plate 26 linear along the rails 28 as soon as the arm 4 carries out the swiveling movement and this movement via the bracket 5 and the rapid-action coupling 6 is transformed into a linear motion of the parts plate 26. The rails 28 and the running elements 30 form the linear guide ways for the parts plate 26 on the base plate 27.

In the rear stop position C the parts plate 26 is positioned outside the tool in its starting position and the tool is closed, in the front stop position D the parts plate 26 with the tool open is completely positioned inside the working area E and takes the working position (see FIG. 4).

The facing the lower tool part 15 of parts plate 26 is provided with a mask 31, which is developed of matched to the contour and geometry of the fine blanking parts 21 openings/recesses 32. The detail X in FIG. 3 shows variations of the design of the mask 31, which for example can be developed as an opening 32 with cover or as a recess 32 on the bottom side of the parts plate 26.

Into the parts plate 26 are recessed several openings 33 and recesses 34, which help to reduce the mass of the plate to reach respective acceleration values and high speeds when the parts plate 26 moves. The base plate 27, besides this, at its front side facing the arm 4 has a recess 35 for the arm 4 and the bracket 5, so that they can penetrate the base plate 27 without contacting it during their motion. Furthermore, the base plate 27 has a recess 56 for letting through the fine blanking parts 21 and further recesses 35 for reducing the mass of the base plate 27.

The rapid-action coupling 6 with capacity limiter 7 is attached in the rear area of the back front side on the top side of the parts plate 26.

The base plate 27 is fixed at the tool plate 16 by distance elements 36. The distance elements 36 extend along the longitudinal sides of the base plate 27 from the facing the rear stop position C front side over a length guaranteeing a secure support and rest of the base plate 27 on the tool plate 16. They have such a height, that the parts plate 26 is about on the level of the cutting die 19 and the ejected precision punching or fine blanking parts 21 can be pressed into the openings 32 of the parts plate 26 by the ejectors 20 in the lower tool part 15.

The parts plate 26 is specifically designed to match with tools and work pieces, i.e. the contour and geometry of the openings 32 in the parts plate 26 are adjusted to the respective geometry of the tool and cutting geometry of the parts (also see FIG. 3).

The rapid-action coupling 6 with capacity limiter 7 make it possible on the one hand to quickly separate the direct drive 2 from the cross slide 8 for changing the parts plate 26 and on the other hand to abruptly separate the bracket 5 from the parts plate 26 in case the parts plate 26 is stuck. The rapid-action coupling 6 enables short change-over times of the press 14 to parts plates 26 with different geometries.

The high-speed removal of fine blanking parts 21 from the working area E defined between the upper and lower tool parts 15 and 22 is carried out as follows.

In the bottom dead center of the ram of the press 14 the opening of the tool between the lower tool part 15 and the upper tool part 22 reaches its maximum value, for example 250 mm.

The driven by the torque motor arm 4 being in the starting position moves and shifts via the bracket 5 the parts plate 26 from its rear stop position C to its front stop position D. The stop position D is the working position, i.e. the parts plate 26 is ready to receive in its openings 32 the pushed out of the cutting die 19 by the ejector 20 fine blanking parts 21.

After the ejector 20 has pressed the fine blanking part 21 into the opening 32 is carried out a reverse of the rotation direction of the torque motor and the arm 4 moves the articulation point A back, so that the parts plate 26 carries out a linear motion from the working position (stop position D) to the starting position (stop position C). The parts plate 26 in doing so takes along the fine blanking parts 21 in its openings 32 to the chute, on which the fine blanking parts 21 then are removed.

The tool closes, that is the ram of the press 14 moves into the top dead center and out of the clamped between upper and lower tool 15 and 22 material strip is cut a new fine blanking part 21 with the shearing punch 24 into the cutting die 19. The removal of the fine blanking part out of the working area E starts anew.

Embodiment 2

With the device of embodiment 2 according to the invention precision punching respectively fine blanking parts 21 and slugs 37 shall be separately removed from the working area E of the tool. The described in embodiment 1 basic structure of the device according to the invention is maintained.

The cross slide—as shown in FIG. 5—differs from the cross slide 8 of embodiment 1 in that on parts plate 26 is arranged a position-fix slug plate 39, which regarding its length matches with the parts plate 26. The slug plate 39 at its respective longitudinal sides is provided with rails 40, between which a slug slide 41 is linearly sliding relative to the sliding position of the parts plate 26 between the starting position and the working position. The slug plate 39 and the rails 40 are attached to the parts plate 26 by screwed connections.

The slug plate 39 and the parts plate 26 have lying one on top of the other congruent clearance holes 53 and 54, which are allocated to the rear stop position C for removing the slugs 37 (see FIGS. 7 and 8).

The slug slide 41 consists of a resting on the slug plate 39 plate 42, running elements 43, a brush ring 44 and an extending along one longitudinal side of the slug plate 39 between rear stop position C and front stop position D fixed on the parts plate 26 rope drive 45. The plate 42, the longitudinal and width dimensions of which are significantly smaller than the longitudinal and width dimensions of the slug plate 39, has an opening 46 and supports a brush ring 44 extending around the opening 46. The flexible brushes 47 of the brush ring 44 are supported on a flange-like developed ring 48 and from this vertically rise up from plate 42. The ring 48 is held on the plate 42 by screwed connections 49. The flexible brushes 47 enable an early start of the drive when lower and upper tool parts open and as far as possible shut up the receiving area.

At the longitudinal sides of the plate 42 are attached the running elements 43 gliding on the rails 40 during the relative motion of the slug slide 41 on the slug plate 39. The rope drive 45 comprises pulleys 50, of which respectively one is allocated to the rear and front stop positions C and D for guiding a rope 51 running between and around the pulleys. The rope 51 is fixedly connected to a stationary attached at the base plate 27 rope holding block and clamped in the clamping point G. During the forward or rearward movement of the parts plate 26 the rope 51 moves around the two pulleys 50 and carries the slug slide 41 via the catch 53 forward and backward.

At the rope 51 for this is clamped a catch 53, which is connected to the fixing of one of the running elements 43 at the facing the rope drive 45 longitudinal side of the plate 42. The clamping point F of the slug slide 41 at the rope 51 has been chosen, so that the slug slide 41 is in its starting position, i.e. in the rear stop position C.

The separate removal of fine blanking parts 21 and slugs 37 from the defined between upper and lower tool parts 15 and 22 working area E is carried out as follows.

The starting position of the described in embodiment 2 modified cross slide 8 is shown in FIG. 7, in which for reasons of clearness the upper tool part 22 has been omitted. In the starting position, i.e. the rear stop position C, the tool is closed and the cross slide 8 is outside the working area E of the tool (see FIG. 6).

The slug slide 41 also has taken its starting position. In other words, the clearance hole 53 in the slug plate 39, the clearance hole 54 in the parts plate 26, the opening 46 in the plate 42 of the slug slide 41 and the recess 55 of the base plate 27 lie one upon the other and open the pass for slugs 37 to the arranged below transport means 9, for example a chute for removing the slugs (see FIG. 8).

FIG. 8 shows the modified cross slide 8 in its working position with the tool opened. The parts plate 26 has moved along its linear guiding of the base plate 27 due to the swiveling movement of the arm 4 into its rear stop position C. Simultaneously to this motion the rope drive 45 has shifted the slug slide 41 on the slug plate 39 to its correlating with the front stop position D working position, due to what the slug plate 39 completely covers the opening 46 in the plate 42. The brush ring 44 due to this forms a receiving area 55 for collecting slugs 37.

With reference to FIG. 6 showing the modified cross slide 8 having moved in between lower tool part 15 and upper tool part 22, in the upper tool part 22 the ejectors 38 are guided inside the shearing punch 24, which serve to eject the slugs 37 as soon as the upper tool part 22 opens respectively the parts plate 26 and the slug slide 41 reached the front stop position D.

The ejected slugs 37 fall into the receiving area 55 of the brush ring 44.

When this is finished the rope drive 45 linearly shifts the slug slide 41 on the slug plate 39 in the direction of the front stop position D. The brush ring 44 comes over the arranged upon each other clearance holes 53 and 54 of slug plate 39 and parts plate 26 as well as the recess 55 of the base plate 27, so that the slugs 37 due to their gravity get onto the transport means 9 for removing the slugs.

The ejector 20 in the lower tool part 15 has pressed the finished punching piece 21 into the opening 32 of the parts plate 26 and the parts plate 26 due to the reverse rotation direction of the direct drive 2 in the linear guiding of the base plate 27 moves in the direction of the rear stop position C. The parts plate 26 during this in the openings 32 carries the fine blanking parts 21 up to the transport means 9, which then removes the fine blanking parts 21. The further sequence is equivalent to that of embodiment 1.

The transport means 9 in this case is a chute, having outlets 10, the width of which approximately corresponds with the dimensions of the fine blanking parts 21. The slugs 37 fall through the clearance hole 54 onto the arranged above and behind the chute for the fine blanking parts next chute.

| List of reference signs | |
|---|---|
| press frame | 1 |
| direct drive | 2 |
| shaft | 3 |
| arm | 4 |
| bracket | 5 |
| rapid-action coupling | 6 |
| capacity limiter | 7 |
| cross slide | 8 |
| transport means | 9 |
| outlet | 10 |
| side walls | 11 |
| terminal box/control device of 2 | 12 |
| control device of the press | 13 |
| press | 14 |
| lower tool part | 15 |
| tool plate | 16 |
| tool change plate | 17 |
| ram | 18 |
| cutting die in 15 | 19 |
| ejector in 15 | 20 |
| fine blanking part | 21 |
| upper tool part | 22 |
| guiding plate in 22 | 23 |
| shearing punch in 22 | 24 |
| pillars | 25 |
| parts plate | 26 |
| base plate | 27 |
| rails at 27 | 28 |
| limit stops at 28 | 29 |
| running elements | 30 |
| mask of 26 | 31 |
| openings/recesses in 26/31 | 32 |
| openings in 26 | 33 |
| recess in 26 | 34 |
| recess in 27 | 35 |
| distance elements | 36 |

-continued

| List of reference signs | |
|---|---|
| slugs | 37 |
| ejector | 38 |
| slug plate | 39 |
| rails at 39 | 40 |
| slug slide | 41 |
| plate of 41 | 42 |
| running elements of 41 | 43 |
| brush ring | 44 |
| rope drive | 45 |
| opening in 42 | 46 |
| brushes of 44 | 47 |
| ring of 44 | 48 |
| screwed connection | 49 |
| pulley | 50 |
| rope | 51 |
| rope holding block | 52 |
| catch | 53 |
| clearance hole of 26, 39 | 54 |
| receiving area | 55 |
| recess in 27 | 56 |
| articulation point | A |
| articulation point | B |
| rear stop position (starting position) | C |
| front stop position (working position) | D |
| working area | E |
| clamping point of catch | F |
| clamping point of rope holding block | G |

The invention claimed is:

1. A device for removing fine blanking parts, which have been precision punched out from a blank, from a fine blanking tool of a fine blanking press having a frame, a ram, an ejector, and tool parts, the tool parts including an upper tool part and a lower tool part, said fine blanking tool being one of said tool parts, the device comprising:

a direct drive fixed to a frame of the fine blanking press, the direct drive comprising a drive shaft, an arm, a bracket and a rapid-action coupling; and a cross slide coupled to said arm via the rapid-action coupling and bracket; and wherein said cross slide has a transverse movement relative to a working direction of the tool parts, so as to move into the working area between the upper and lower tool parts when one of the tool parts opens and so as to move out of the working area with one or more of the fine blanking parts when one of the tool parts closes;

wherein the direct drive converts a rotating motion of the drive shaft into a linear motion of the cross slide so as to achieve said transverse movement, wherein the direction of the linear motion reverses, in dependence on a stroke of the ram, between a rear stop position and a front stop position of the cross slide in the working area;

wherein the cross slide comprises a base plate and a parts plate, the parts plate movable between the front stop position and rear stop position while being guided on rails positioned on the base plate; and wherein the parts plate comprises a mask having a plurality of openings with contours and geometries corresponding to a geometry of said fine blanking tool and a cutting geometry of the fine blanking parts, said parts plate receiving into said plurality of openings the fine blanking parts pressed into said plurality of openings by said ejector so as to hold said fine blanking parts during a distance portion of said transverse movement for unloading the fine blanking parts from the fine blanking press.

2. The device according to claim 1, wherein the upper tool part is arranged at one of the ram and the frame of the fine blanking press and the lower tool part is arranged at another of the frame and the ram.

3. The device according to claim 2, wherein the lower tool part comprises at least one cutting die and one ejector and wherein the upper tool part comprises at least one shearing punch, one guiding plate and one ejector.

4. The device according to claim 1, wherein the cross slide further comprises a slug plate fixedly arranged onto the parts plate, and a slug slide horizontally movable on rails relative to the parts plate, the slug slide being movable between a rear stop position at which a clearance hole in the slug plate, a clearance hole in the parts plate and a recess in the base plate are aligned, and a front stop at which the slug slide is between the tool parts.

5. The device according to claim 4, wherein the parts plate comprises one piece.

6. The device according to claim 4, wherein an opening in the parts plate, an opening in the slug plate and a recess in the base plate are configured so as to be congruently arrangable over each other in a vertical direction.

7. The device according to claim 1, wherein the slug slide further comprises a brush ring and a retaining plate, wherein the brush ring and the retaining ring are moved between the front and rear stop positions on the slug plate by means of a rope drive connected to the slug slide and arranged alongside a rail, wherein the brush ring and the slug plate form a receiving area for slugs which are collected therein after being the removed by the ejector and wherein the slugs are moved by the rope drive to a position relative to the position of the parts plate where the clearance holes of the slug plate, the parts plate and the base plate align so that the slugs will fall due to their gravity below the parts plate and into a transportation means.

8. The device according to claim 7, wherein the rope drive for moving the slug slide between the stop positions further comprises pulleys arranged at one longitudinal side of the parts plate an endless rope running around the pulleys and a catch fixed at the retaining plate of the slug slide and configured at the rear stop position and wherein the catch clamps a rear portion of the rope facing the longitudinal side of the parts plate in the rear stop position.

9. The device according to claim 7, wherein the rope drive is effectively connected with the parts plate by a rope holding block which is fixed at the front stop position to the base plate, and wherein the rope holding block fixes the longitudinal side of the parts plate front portion of the rope.

10. The device according to claim 1, wherein the parts plate further comprises a locking/unlocking mechanism, which provides for unlocking the parts plate as soon as the fine blanking parts are not taken up by the openings in the parts plate.

11. The device according to claim 1, wherein the direct drive is liquid-cooled.

12. The device according to claim 1, wherein the direct drive is operatively connected to a triggering control of the press.

13. The device according to claim 1, further comprising: a chute underlying the parts plate, and onto which at least one of the fine blanking parts is received for transport from the fine blanking press.

14. The device according to claim 13, wherein said chute is a first chute, and further comprising a second chute separately arranged from the first chute for separately removing slugs from the fine blanking press, wherein the second chute for the slugs is subordinated to the first chute for the fine blanking parts.

15. The device according to claim 13, wherein the chute has outlets arranged side by side with walls extending up from a floor of the chute dividing the chute into the outlets, the walls allowing for the separation of the fine blanking parts.

16. The device according to claim 1, wherein a pivoting arm is connected to a bracket on the parts plate belonging to the cross slide by a rapid-action coupling and a capacity limiter.

17. The device according to claim 1, wherein the base plate of the cross slide has a bracket and a recess arranged at the bracket so that the plate is penetrated into the recess during the movement of the bracket.

18. The device according to claim 1, wherein the parts plate is designed to match with punching tools and punched work pieces of the present invention, and is further designed so that it can be exchanged with other parts plates.

19. The device according to claim 1, further comprising a direct drive controller configured to position the parts plate so that the mask openings are aligned with the geometry of said fine blanking tool in a manner allowing the ejector to press the punched out fine blanking parts into the openings of the mask.

* * * * *